United States Patent [19]

Chang

[11] Patent Number: 4,796,555

[45] Date of Patent: Jan. 10, 1989

[54] KNOCKDOWN TYPE INFLATABLE SAILBOAT

[76] Inventor: Herry Chang, No. 371-7, Hsin Ming Road, Nei Hu District, Taipei, Taiwan

[21] Appl. No.: 105,526

[22] Filed: Sep. 29, 1987

Related U.S. Application Data

[63] Continuation-in-part of Ser. No. 16,360, Feb. 19, 1987, abandoned.

[51] Int. Cl.[4] ..... B63B 7/08

[52] U.S. Cl. ..... 114/39.1; 114/61; 114/345

[58] Field of Search ..... 114/39.1, 61, 123, 283, 114/292, 357, 345; 441/40

[56] References Cited

U.S. PATENT DOCUMENTS

| | | | |
|---|---|---|---|
| 2,391,326 | 12/1945 | McKinley | 114/292 |
| 3,141,435 | 7/1964 | Moffitt | 114/61 |
| 3,473,502 | 10/1969 | Wittkamp | 114/61 |
| 3,786,774 | 1/1974 | Gabel | 114/292 |
| 3,796,175 | 3/1974 | Ford et al. | 114/357 |
| 3,846,858 | 11/1974 | Syfritt | 114/61 |
| 4,348,971 | 9/1982 | Montgomery | 114/61 |
| 4,437,424 | 3/1984 | Lord | 114/61 |

*Primary Examiner*—Sherman D. Basinger
*Assistant Examiner*—Stephen P. Avila
*Attorney, Agent, or Firm*—Lowe, Price, LeBlanc, Becker & Shur

[57] ABSTRACT

A knockdown type inflatable sailboat which has a carrier system composed of two inflatable rafts assembled with a plurality of U-like fastening elements of a hull assembly and which uses a power system located on the bow with a main mast to support a sail which is further fastened by means of a rod and two riggings, and a steering system composed of rudders and water breakers.

12 Claims, 10 Drawing Sheets

KNOCKDOWN TYPE INFLATABLE SAILBOAT

This application is a continuation-in-part of application Ser. No. 16,360, filed Feb. 19, 1987 now abandoned.

BACKGOUND OF THE INVENTION

The present invention is coming after U.S. Pat. No. 16,360. In the previously quoted U.S. Pat. No. 3,473,502 of Wittkam, the short leg (60) is a U-like shape which can not provide sufficient supporting effect, and further, the connecting part between Support (22*a*) (226) and short leg is easy to be damaged or deformed.

In U.S. Pat. No. 3,141,435 of Moqqitt, it is a trandi-tional sailboat mainly made of solid materials of wooden boards and fiber glass resins, the demerits of which are big in size, heavy in weight, inconvenient for carriage and storage, high in cost, and difficult to become popular.

The main objective of the present invention is to provide a knockdown type inflatable sailboat with the following merits:

1. Light and compact that makes moving and storage convenient. It is of knockdown design, light and compact.
2. High safety factor. It is composed of two independent inflatable rafts each in the form of a kidney and each incorporated with four independent air valves for inflation. Stress elimination is taken in consideration to assure safe operation.
3. Strong and stable. The inflatable rafts are assembled by means of U-like fastening rods, stress rods and connecting elements. Its structure is strong, durable, stable and reliable.
4. Good maneuverability from double-ruddler design.
5. Large loading surface. It has a polygonal loading surface to incense carriage.
6. Water breakers are placed on bottom of inflatable rafts to facilitate control on sailing.
7. The kidney-like inflatable rafts can be replaced by straight tube type inflatable rafts to lower production cost and to minimize possibility of defected products.

SUMMARY OF THE INVENTION

The present invention provides a knockdown type inflatable sailboat, particularly a light, compact, durable, stable and reliable sailboat which can be transported and stored easily. It is composed of two inflatable rafts each in the form of a kidney or a straight tube, and each incorporated with a plurality of air valves to secure safety. The rafts are connected a by a plurality of U-like fastening rods of a stress elimination system on two lateral sides. The sailboat assembly is formed by means of stress rod in the middle recession of the U-like fastening rod, and connecting elements. Power system is located on the bow. It has a main mast for a sail which is further fastened by a rod and two riggings, forward sailing is controlled by the riggings, and a steering system composed of rudders and water breaker is used to control direction of sailing.

BRIEF DESCRIPTION OF THE DRAWINGS

FIG. 4-1 illustrates a structure of the water breaker of the present invention.

FIG. 5-1 illustrates a fixing structure between stress rods and connecting elements of the present invention.

FIG. 5-2 illustrates a structure of the fixing holders of the present invention.

FIG. 5-3 illustrates a structure between connecting elements and strut of the present invention.

FIG. 6-1 is a perspective view of thimble pipe (3035) of the present invention.

FIG. 6-2 is a perspective view of thimble pipe (3036) of the present invention.

FIG. 6-3 is a cross-sectional view of the upper cover plate of the present invention.

FIG. 6-4 illustrates a structure of the upper cover plate of the present invention.

FIG. 6-5 is another cross-sectional view of the upper cover plate of the present invention.

DESCRIPTION OF THE PREFERRED EMBODIMENTS

Figures 1, 1A, 2:
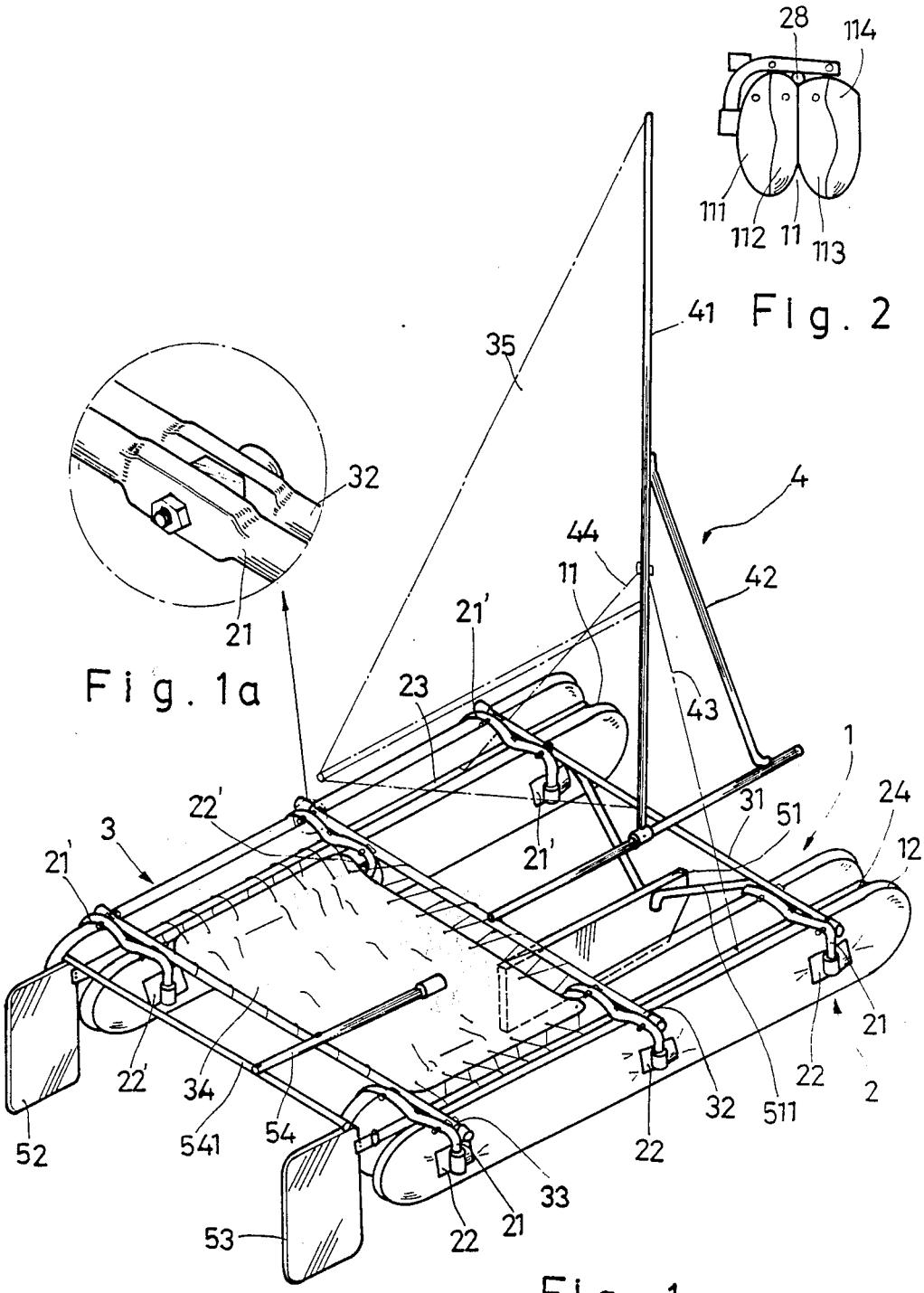
FIG. 1 is a perspective view of a sailboat embodying the present invention. (1)
FIG. 1*a* illustrates the fixing between U-like fastening rods and connecting elements of the present invention.
FIG. 2 is a front view of the rafts of the knock-down type inflatable sailboat of the present invention.

FIG. 1 is a perspective view of a knockdown type inflatable sailboat, an embodiment according to the present invention. As shown in the drawing, it is mainly composed of a carrier system (1), a stress elimination system (2), a hull assembly system (3), and a power and transmission system (4) and a steering system (5).

The carrier system (1) comprises two inflatable rafts (11 and 12) each in the form of a kidney. Please refer to FIG. 2, each inflatable raft (11 or 12) has four independent air valves (111, 112, 113, 114) and therefore, there are eight air valves on these two inflatable rafts (11 and 12) for inflation of the rafts.

Please refer to FIG. 1, the stress elimination system (2) is incorporated with a plurality of U-like fastening rods (21) to fix the inflatable rafts (11 and 12) at two lateral sides. Each fastening rod (21) has a stress elimination surface (22) at one end and another stress elimination surface (22') at the other end to be subject to stress. In this embodiment, 12 stress elimination surfaces (22, 22'). Below the middle recession of each fastening rod (21) a stress rod (23) is placed to support the inflatable raft (11 or 12) and to eliminate stress thereon. The stress rod (23) according to the present invention may be enlarged, or number of which may be increased to meet individual requirements.

The hull assembly system (3) according to the present invention is composed of three connecting elements (31, 32, and 33) to incorporate two inflatable rafts (11 and 12). These three connecting elements (31, 32, and 33) are placed across two fastening rods (21 and 21') and fixed above the fastening rod (21), as shown in FIG. 1*a*. The longer the connecting element (31, 32 or 33), the more stable the assembly, and the more stable the sailboat, the more number of people it can carry. The sail (34) according to the present invention is tied between the connecting element (32) and the stress rod (23 or 24)

by ropes in four directions for the largest wind load surface.

The power and transmission system (4) according to the present invention is located on the bow of the sailboat. It comprises a mast (41) to support a sail (34) which is further fixed by a rod (42) and two riggings (43, 44) to improve its stability. Since the sail surface to receive wind power is large, the hull according to the present invention has a relative high carriage capacity.

The steering system (5) according to the present inventions composed of a water breaker (51) and two rudders (52, 53). The water breaker (51) is to break water ahead for maintaining sailing direction, and the ruddlers (52, 53) are for manual steering purpose via a handle (54).

Figure 3:
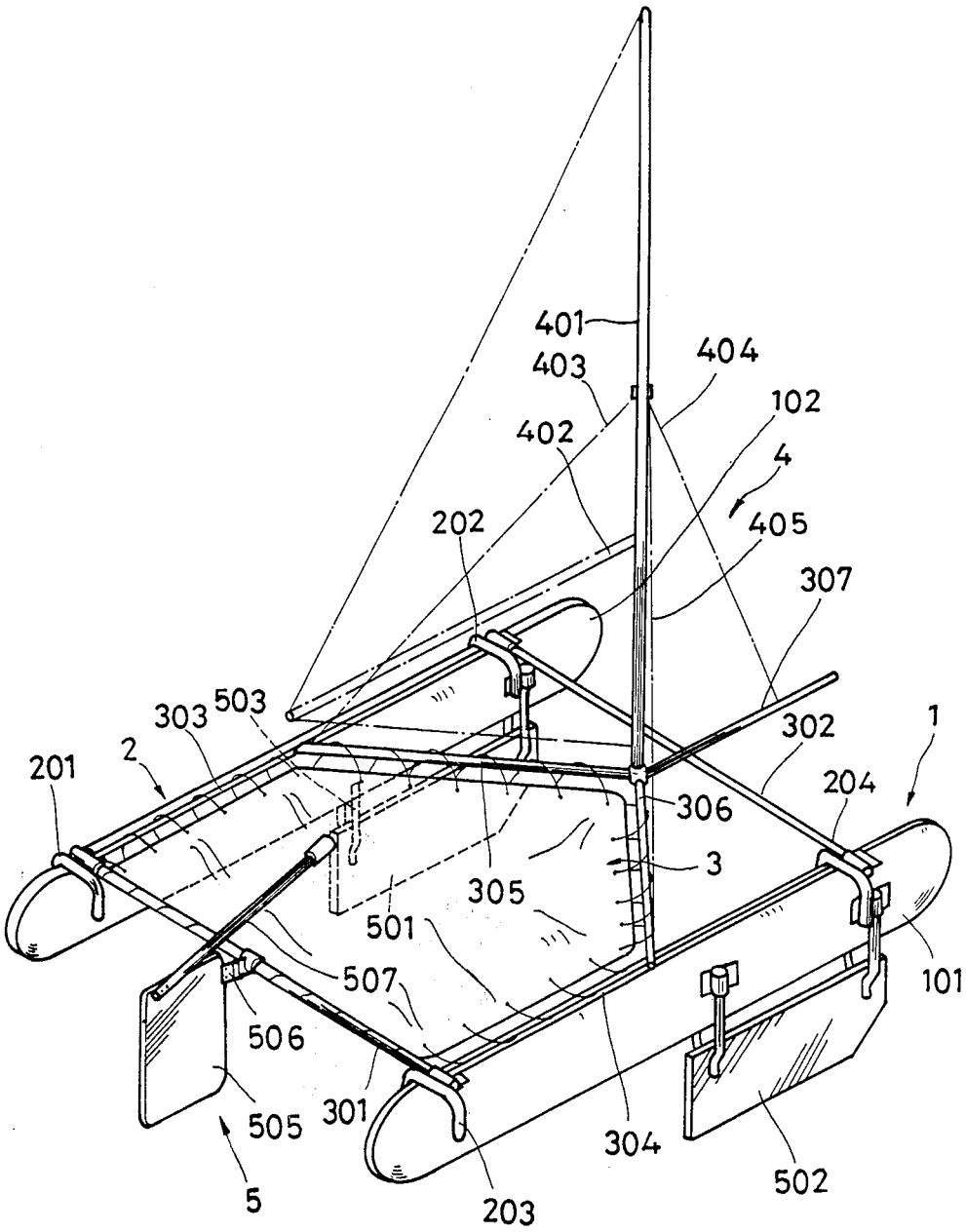
FIG. 3 is a perspective view of another preferred embodiment. (2)

FIG. 3 is a perspective view of another embodiment according to the present invention. The carrier system (1) is composed of a pair of inflatable rafts (101, 102) each in the form of a straight tube, and each raft (101 or 102) is equipped with a plurality of independent air valves for inflation.

The stress elimination system (2) is substantially the same with that shown in FIG. 1. It includes a plurality of U-like fastening rods (201, 202, 203, 204) for fixing the inflatable rafts (101 and 102) at two lateral sides. The hull assembly system (3) has two connecting elements (301 and 302) each with its two ends fixing to the fastening rods (201, 202, 203 and 204) to form a complete assembly. The stress rods respectively and two support rods (305 and 306) are connected to the middle of the stress rods (303 and 304) at appropriate position, a front rod (307) is connecting the joint between the support rods (305 and 306) while another end of the front rod (307) is intersecting with a connecting element (302) for form an integrated assembly.

A mast (401) is installed at the intersection among the support rods (305 and 306) and the front rod (307) to support a sail which is fixed by three riggings (403, 404, and 405).

The power and transmission system (4) shown in FIG. 3 is identical to that in FIG. 1, and description of which will not be repeated here. The steering system (5) includes two water breakers (501 and 502) located at respective appropriate positions below the inflatable rafts (101 and 102). A ruddler (505) is located in the middle of the connecting element (301) via a knuckle (506) for steering with a handle (507). The connecting elements (301 and 302), the stress rods (303 and 304) and the support rods (305, 306, and 307) are fastened firmly, and the U-like fastening rods (201, 202, 203 and 204) are firmly fixed to the connecting elements (301 and 302) to prolong service life of the present invention.

The support rods (305 and 306) are designed to give a pentagonal surface for carriage of people. It does not only extend space for people thereon, and uses support rods (305 and 306) instead of connecting rods (301 and 302) to bear part of load to it. It allows persons on it to repair sail directly in the course of sailing and to return coast with its own power without towing. It is a design which eases repair and improves safety in operation.

Figure 4:
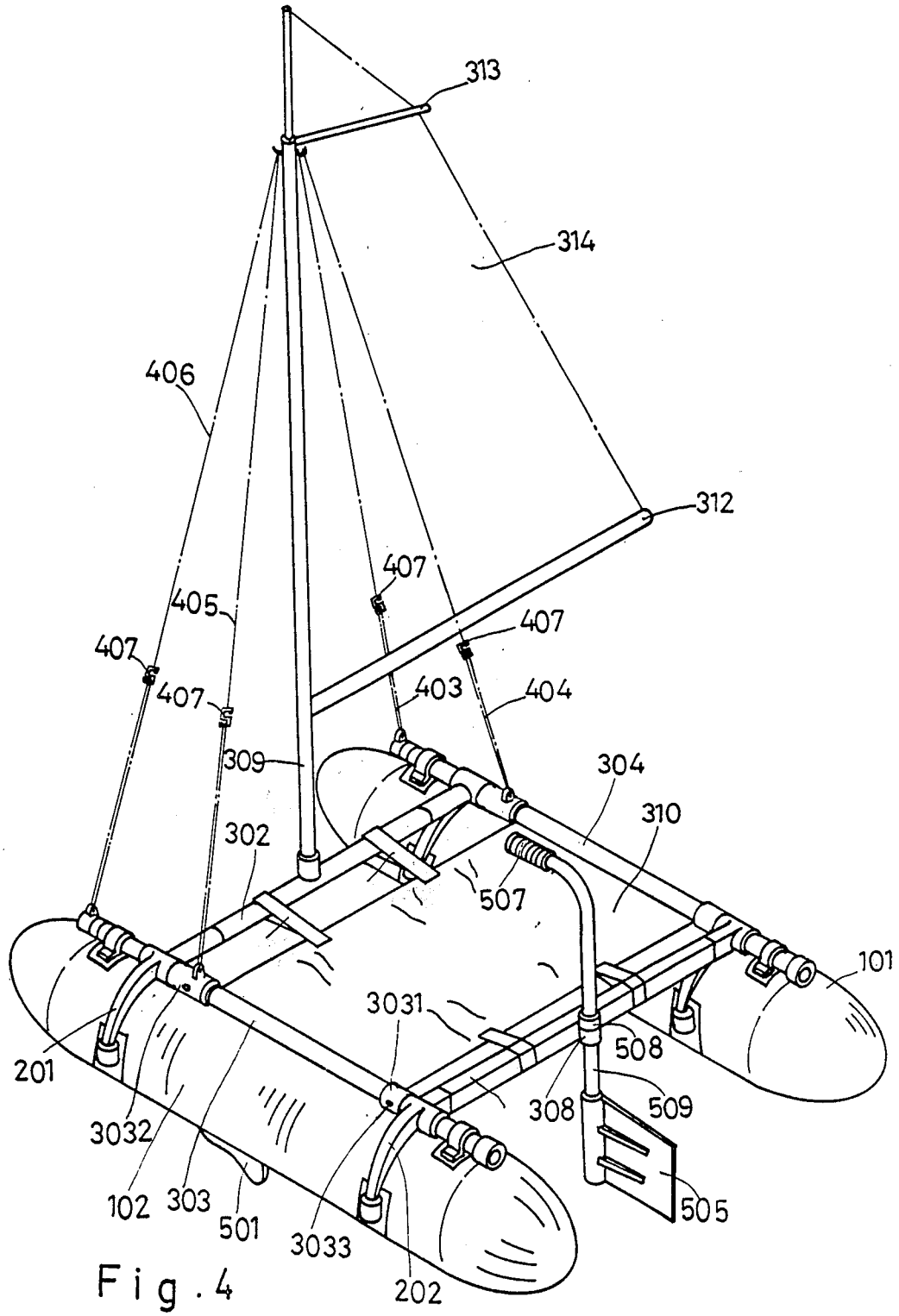
FIG. 4 is a perspective view of another further preferred embodiment of the present invention. (3)

As shown in the drawing of FIG. 4, the U-like fastening rods (201) (201)′ (202) (202)′ are of same structure. The U-like fastening rod (201) has a holly socket in the middle, composed of two curved fastening rods (2012) (2012)′ facing downward (2012)′ not shown in the drawing wherein the round-shaped tube (2013) is for insertion of connecting element (302); the socket (2011) is for insertion of stress rod (303) to lock at proper position.

When two stress rods (303) (304) and two connecting rods (301) (302) are respectively connected to the four U-like fastening rods (201) (202)′ (203) (204), by means of fixing of fixing clamp from the sail the hull assembly is unitarily fixed as a full assembly.

The connecting element (301) has a ring (508) for insertion of a strut (508) from the handle (507) to control steering via the rudder (505) and by means of a locking flange (509) to lock at the ring (508), and the connecting element (302) has socket (309) in the middle for holding of a support road (401) which is incorporated with a plurality of riggings (403, 404, 405, 406), tension of such riggings si controlled by a connector (407). The sail (310) is supported by support rods (312) (313).

To prevent the connecting elements (301) and (302) from loosening, the sail (504) of the present invention provides sleeves for insertion of connecting elements (301) (302) so as to fix the connecting elements (301) (302) and stress rods (303) (304) as a full assembly by means of the tension of sail (304) when it is stressed.

The stress rods (303) (304) are of same structure, each comprises two thimble pipes (3031) (3032) and is fixed by bolt (3033) to stress rod (303) properly so that the thimble pipes can undertake the tension to prevent itself from gathering together while U-like fastening rod (201) is stressed by the sail.

Each stress rod (303) (304) of the present invention is united together by several sections, according to demand, for easy package. As shown in FIG. 4, one piece of rod is inserted into a thimble pipe (3031) at proper position and firmly fixed thereto so that another piece of rod can also insert into the thimble pipe from the other end to form as one united stress rod which gets more stable through the traction of canvas (310).

FIG. 4-1 shows the structure of water breaker beneath the raft. The block-shaped water breaker (501) comprises pierced holes (5011) (5012) in the middle, wherein the fixing rod (5013) is inserted into the pierced hole (5011) of the water breaker (501) through the holes (1061) (1071) of fixing holders (106) (107) beneath the raft (101) and coming out from another pierced hole (5012) of the water breaker (501) and finally is well locked by its locking flange (5014) so that the water breaker can be firmly fixed to each raft by means of the air pressure while the raft is fill up with air to keep itself closely contact the respective water breaker.

The number of fixing rods can be increased according to the stress undertaken by water breaker (501).

Figures 2, 5:
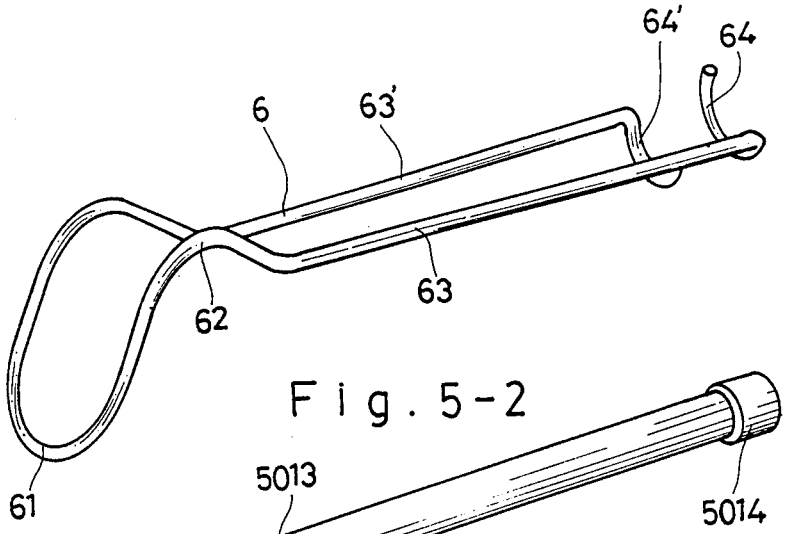
FIG. 5 is a perspective view of the other preferred embodiment. (4)
Figures 1, 4:
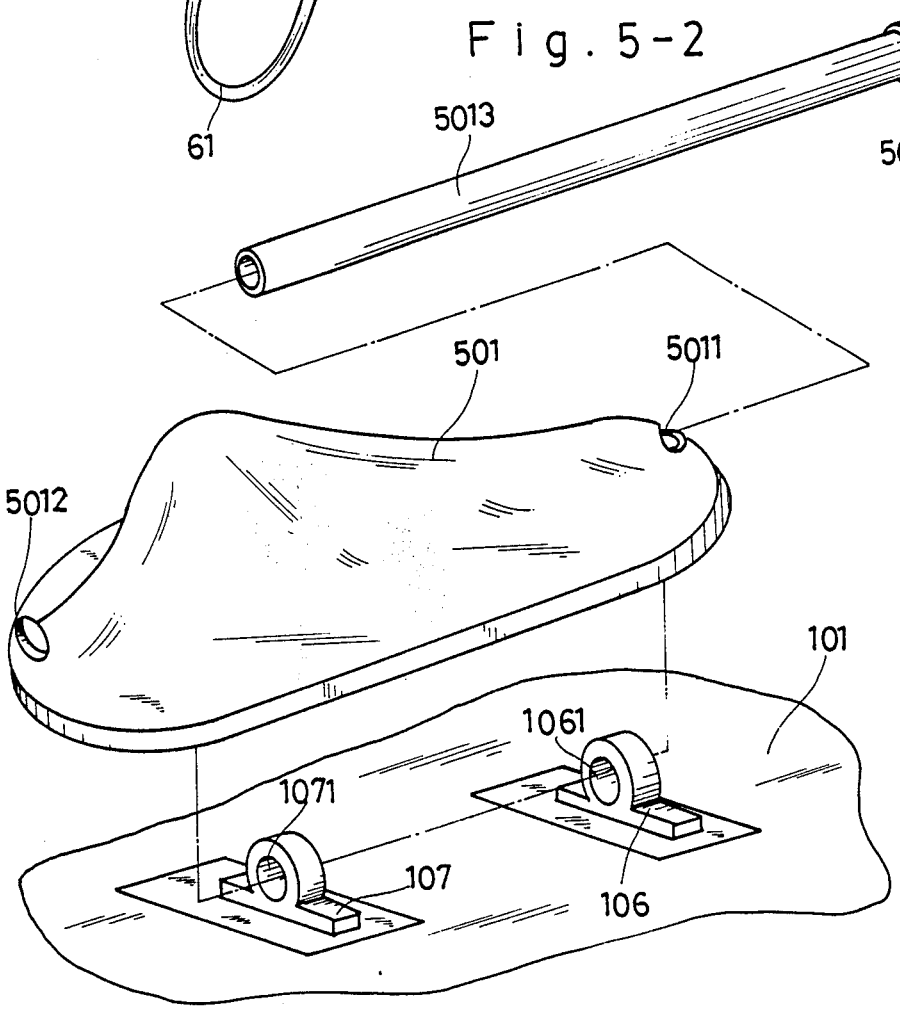
Figures 1, 5:
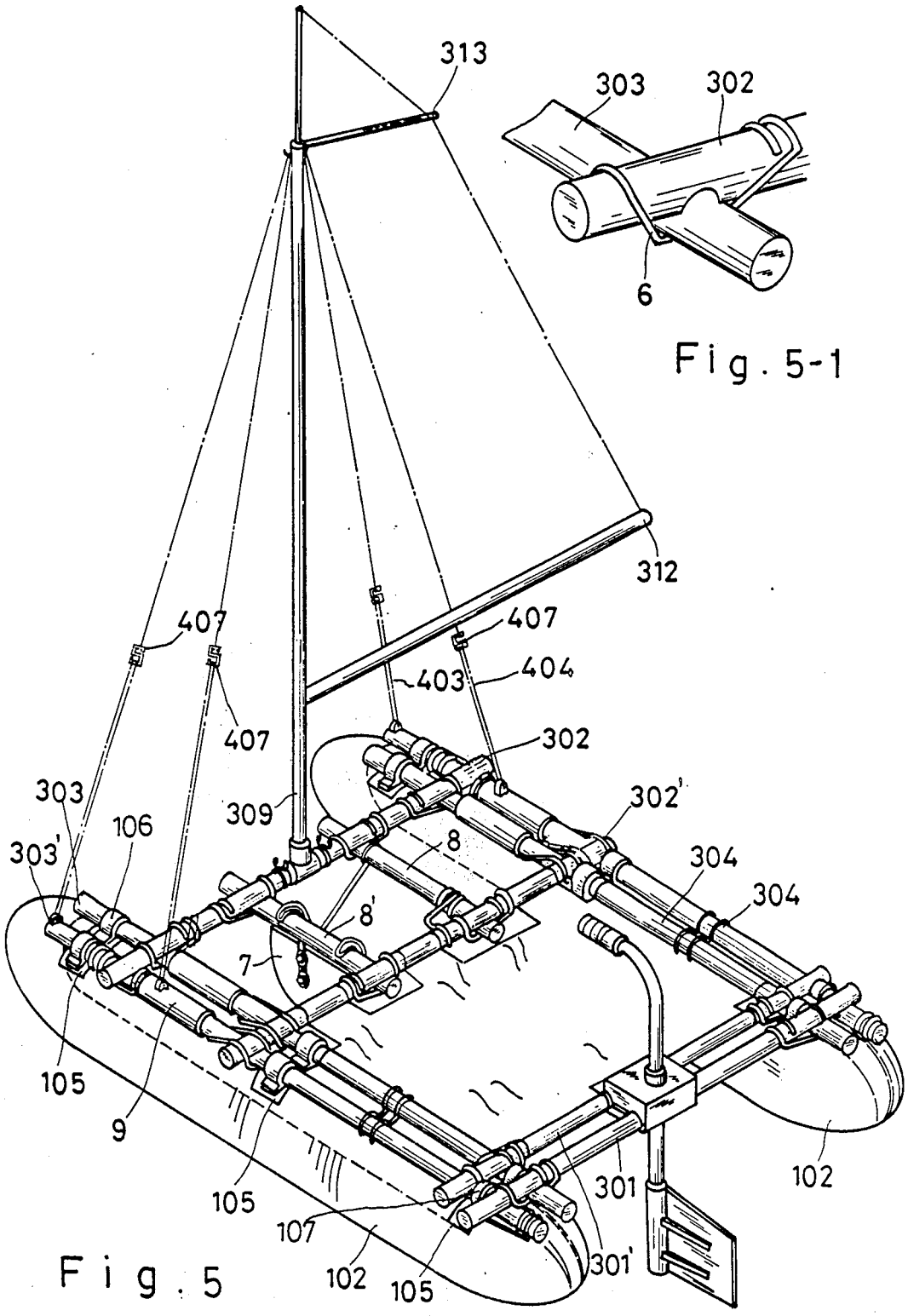
Figures 3, 5:
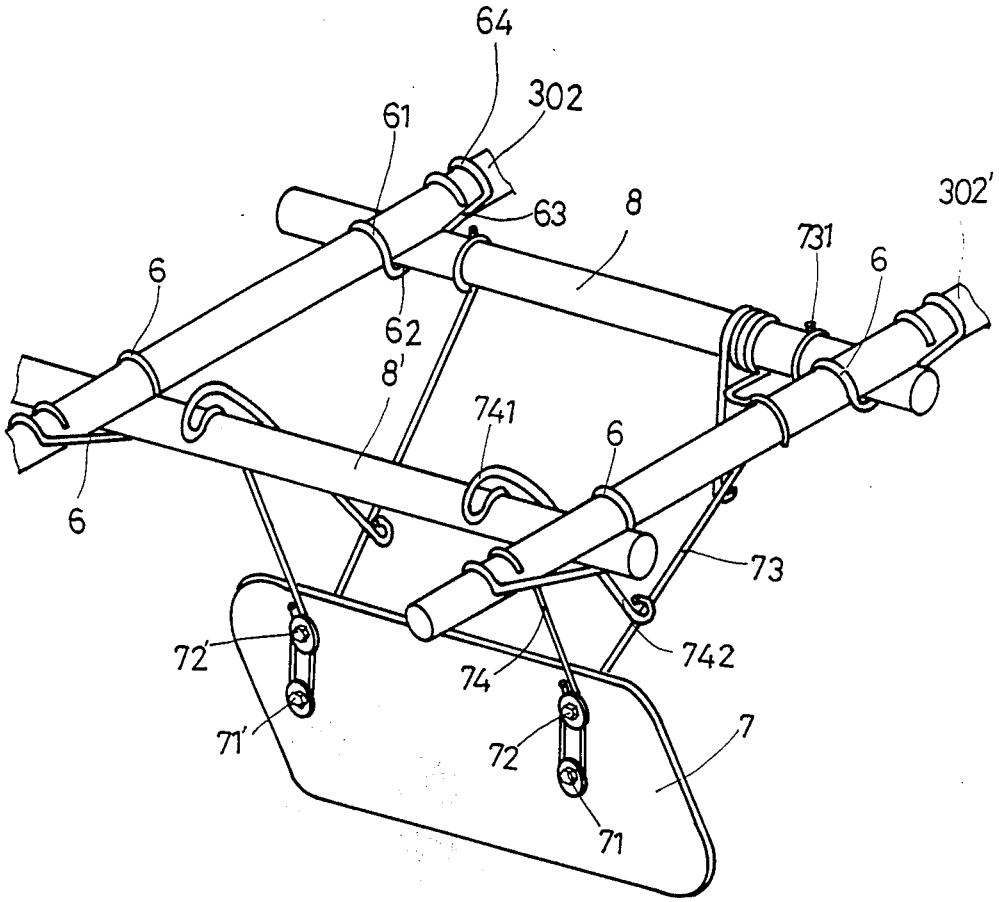

According to the drawing of FIG. 5, FIG. 5-1, each raft comprises two stress rods (303) (303)′ and (304) (304)′ respectively. The connecting elements (301) (301)′ (302) (302)′ are placed superiorly across the stress rods (303) (303)′ (304) (304)′. In order to place the connecting elements on a fixed location, all the connecting elements (301) (301)′ (302) (302)′ and stress rods (303) (303)′ (304) (304)′ are comprising a curved dent at contact point with a fixing holder (6) to fix thereto. Please refer to the drawing of FIG. 5-2 for the structure of the fixing holder. The fixing holder composes at one end a curved tube (61) for inserting into one end of connecting element (302). The other end of the fixing holder extends inferiorly over the stress rod (303) to lock at the socket (62) of the curved tube. The straight rods (63) (63)′ of the fixing rod (6) are designed according to requirement. The longer the straight rods the easier the fixing. However, the longer the straight rods are the larger the space required for location. The other ends of straight rods (63) (63)' comprise respective curved racks (64) (64)' for connection to the other end of connecting element (302).

The drawing of FIG. 5-3 shows the fixing type of the water breaker of the present invention wherein two struts (8) (8)' are placed between connecting rods (302) (302)' and well connected by means of fixing holders (6) which are arranged by hand without using tools.

A support rod (73) and a clamping rod (74) both are firmly fixed by respective screw (71) (72) and (71)' (72)' to each water breaker. The other end of the support rod (73) is a round tube for insertion of strut (8). And the other end of the clamping rod (74) comprises a curved clamp device (741), the clamping range of which is controlled by a pressure-control rod (742) in a manner that when the pressure-control rod is pressed the clamping device is opened for receiving the strut (8) and when the rod is pressed out the clamping device firmly clamps the strut (8) by means of its clamping muzzle. The water breaker is evenly supported by support rod (73) and clamping rod (74) on both ends to keep standing between.

To present the water breaker (7) from damage due to the pressure of the hull assembly while it is assembled on beach, the clamping rod (74) can be dismantled so that the water breaker become detachable and supported by the support rod (7) only.

The fixing and connecting type applied in the present invention is easy assemble and disassemble without need of screws or tools wherein the tension of each raft (101) (102) produced by air inflation keeps each connecting element (302) (302)' (301) (301)' be firmly connected to respective stress rod (303) (303)' (304) (304)'.

The raft (101) of the present invention comprises a plurality of fixing holders (105) for insertion of stress rods (303) (303)'. The stress rods (303) (303)' can be devided into separate sections according to requirement for the convenience of packing and transportation wherein a socket (9) is placed between each two sections. Because the stress rods (303) (303)' are evenly placed on the upper surface of the raft (101) and connecting elements are placed superiorly across the stress rods, while the sailboat undertakes heavy load the pressure is evenly distributed over the upper surface of the raft (101) so that the sailboat can undertake heavier loading.

Figure 6:
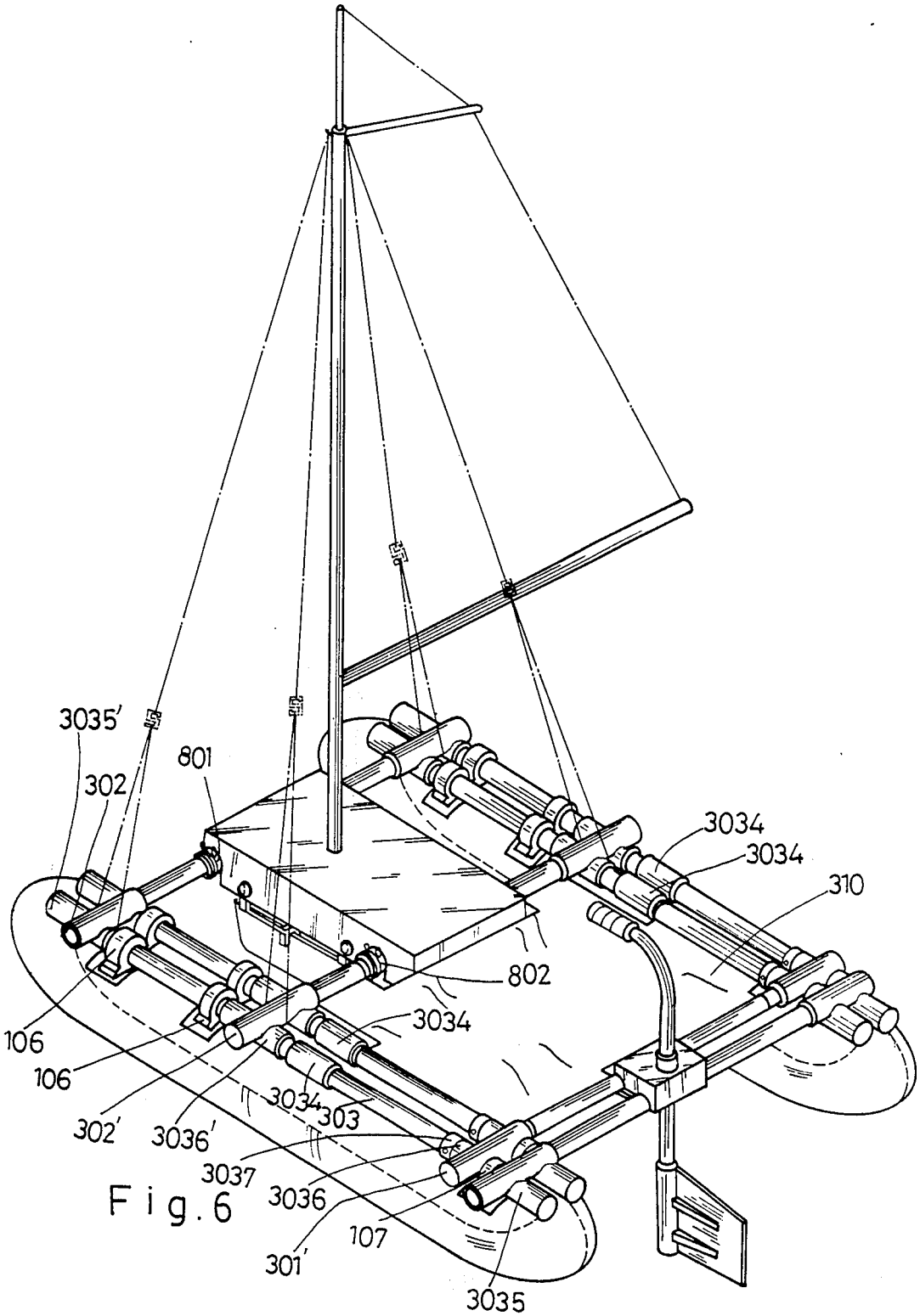
FIG. 6 is a perspective view of the other preferred embodiment of the present invention.
Figures 2, 6:
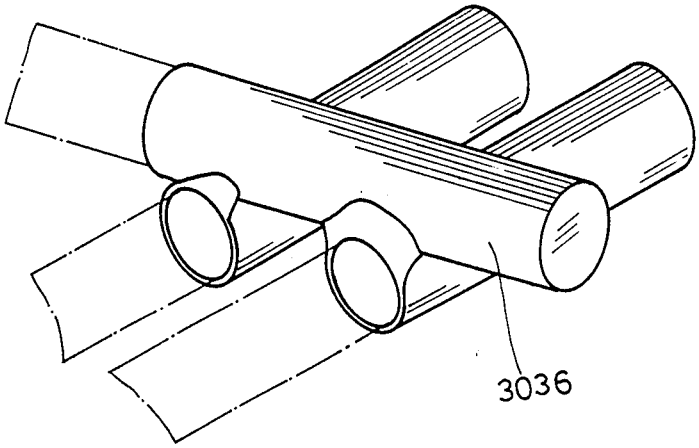
Figures 1, 6:
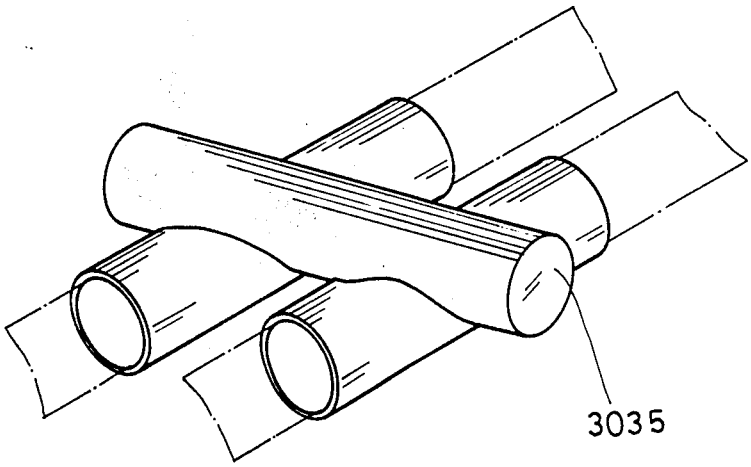
Figures 3, 6:
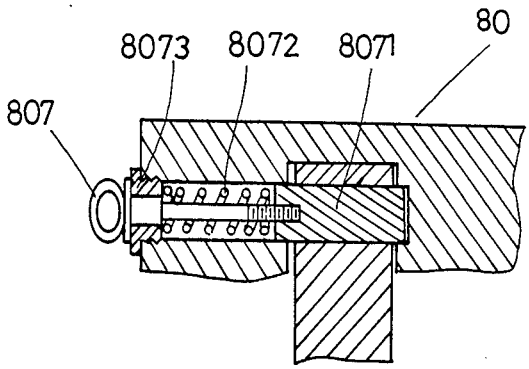
Figures 5, 6:
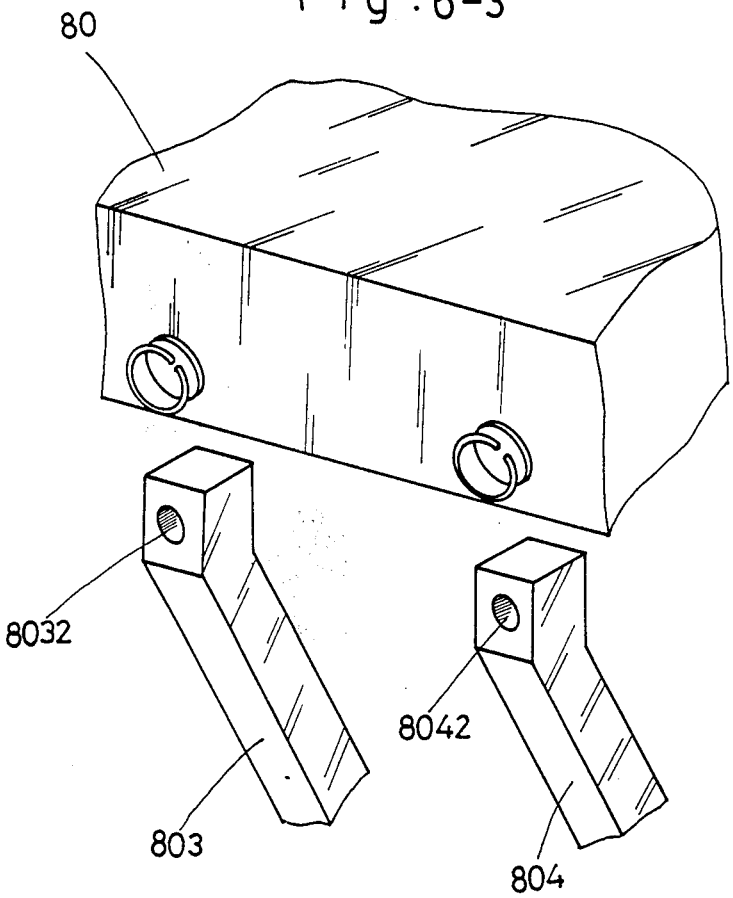
Figures 4, 6:
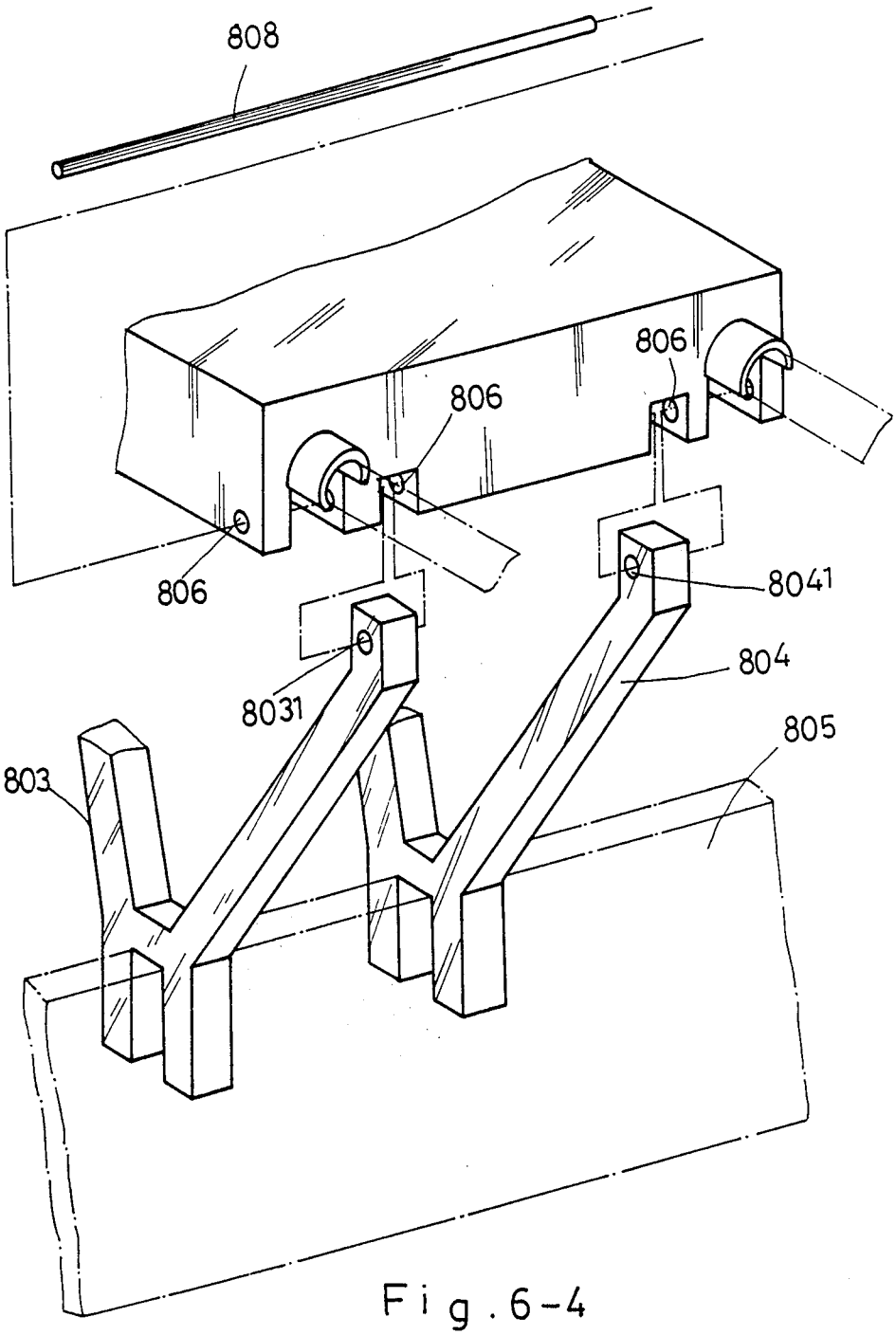

According to the perspective view of FIG. 6, one section of stress rod (303) is inserted into fixing holder (107) through fixing stand (3036) and another fixing holder (107)' and then blocked at fixing stand (3035); the other section of the stress rod is inserted into fixing holder (106) (106)' through fixing stand (3036)' and thimble pipe (3034) and finally blocked at fixing stand (3035)'. Same type of thimble joint is applied for both left and right stress rods. Connecting elements (301)' (302)' are inserted into fixing stand (3036) (3036)' and canvas (310) for fixing, another connecting elements (301) (302) are then inserted and fixed in same manner. As stress rods are fixed by thimble pipe (3034) on one end and fixing ring (3037) on the other end, when canvas (310) undertakes heavy load, connecting elements (301) (301)' (302) (302)' and stress rods (303) (303)' (304) (304)' are evenly giving a support.

FIG. 6-1 illustrates a structure of fixing stand (3036) and FIG. 6-2 illustrates a structure of fixing stand (3035) wherein two thimble pipes are placed for receiving stress rods and one other thimble pipe for receiving connecting element. Each of the two thimble pipes of the fixing stand (3035) for receiving stress rod is closed at one end to block and locate inserted stress rod. The fixing stand (3036) is a pierced thimble pipe.

As shown in FIG. 6 and FIG. 6-3, the upper cover plate (80) is a flat plate which comprises inferiorly two curved surface (801) (802) for locating connecting elements (303) (303)', and two fixing bars (803) (804) for respectively clamping a water breaker (805). Said fixing bars (803) (804) comprise respective pierced holes (8031) (8041) for bolt (808) to fix the bars (803) (804) to respective curved paths (806) (806)' via another pierced hole (806). Another pierced holes (8032) (8042) of the fixing bars (803) (804) are blocked by blocking bar (8071) via fixing button (807). Please refer to FIG. 6-4 and FIG. 6-5 for the structure of fixing button (807), which structure comprises a blocking bar (8071) with a spring (8072) slipped on and a washer (8073) to fix the spring (8072) wherein the control button (807) controls locating of fixing bars by means of controlling expansion and contraction of the blocking bars (8071).

I claim:

1. A knockdown type inflatable sailboat comprising:
twin inflatable, elongated mutually spaced rafts having sides and fore and aft ends;
breakwater means disposed beneath said rafts for stabilizing said sailboat;
stress elimination system including a plurality of U-shaped fastening rods disposed on the upper surface of said rafts in a mutually spaced relationship with the ends thereof depending on opposite sides of said rafts;
stress distribution means coupling the ends of each U-shaped rod to a corresponding side portion of said raft whereby weight disposed on said U-shaped rods will be carried by the sides of said rafts said means comprising a plurality of mutually spaced plates, each plate affixed to a side of a raft adjacent an end portion of each of said U-shaped rods and a plurality of sleeves, each mounted on one of said plates surrounding an end each of said U-shaped rods;
at least one stress rod extending substantially the length of each raft along the upper surface thereof interconnecting respective U-shaped fastening rods, and at least three connecting rods extending laterally between said rafts connecting a pair of U-shaped rods thereon;
rudder means carried by said sailboat at the aft end of aid rafts for steering said sailboat;
sail means including a mast mounted on a connecting rod connecting the fore ends of said rafts.

2. The sailboat of claim 1 wherein said rafts are kidney shaped.

3. The sailboat of claim 2 when said breakwater means includes a single breakwater disposed depending from a connecting rod between said rafts.

4. The sailboat of claim 1 wherein said rudder means includes twin rudders, one disposed behind each of said rafts.

5. The sailboat of claim 1 wherein each raft comprises interconnected pontoons interconnected along a longitudinal side.

6. The sailboat of claim 1 wherein said rudder means comprises a single rudder disposed to depend from a connecting rod and located between said rafts.

7. A knockdown type inflatable sailboat comprising:

twin inflatable, elongated mutually spaced rafts having sides and fore and aft ends;

breakwater means disposed beneath said rafts for stabilizing said sailboat;

stress elimination system including a plurality of U-shaped fastening rods disposed on the upper surface of said rafts in a mutually spaced relationship with the ends thereof depending on opposite sides of said rafts;

stress distribution means coupling the ends of each U-shaped rod to a corresponding side portion of said raft whereby weight disposed on said U-shaped rods will be carried by the sides of said rafts said means comprising a plurality of mutually spaced plates, each plate affixed to a side of a raft adjacent an end portion of each of said U-shaped rods and a plurality of sleeves, each mounted on one of said plates surrounding an end each of said U-shaped rods;

at least one stress rod extending substantially the length of each raft along the upper surface thereof interconnecting respective U-shaped fastening rods, and a plurality of connecting rods extending laterally between said rafts each releasably connecting a pair of U-shaped rods thereon;

a deck extending between and releasably connected to said stress rods;

each U-shaped rod mounting a laterally opening sleeve on the upper surface thereof which receives an end of a connecting rod therein so that when said deck is connected to said stress rods said connecting rod end are retained in said sleeves, and when said deck is loaded the stress rods will be urged together and the ends of the connecting rods will be tightly retained in the sleeves;

rudder means carried by said sailboat at the aft end of said rafts for steering said sailboat;

sail means including a mast mounted on a connecting rod connecting the fore ends of said rafts.

8. The sailboat of claim 7 wherein the rafts are kidney shaped.

9. The sailboat of claim 7 wherein said breakwater means includes a single breakwater disposed depending from a connecting rod between said rafts.

10. The sailboat of claim 7 wherein said rudder means includes twin rudders, one disposed behind each of said rafts.

11. The sailboat of claim 7 wherein each raft comprises interconnected pontoons interconnected along a longitudinal side.

12. The sailboat of claim 7 wherein said rudder means comprises a single rudder disposed to depend from a connecting rod and located between said rafts.

* * * * *